United States Patent [19]

Groswith, III

[11] Patent Number: 4,973,085

[45] Date of Patent: Nov. 27, 1990

[54] END-REINFORCED BOOKBINDING STRIP FOR IMPACT RESISTANCE

[75] Inventor: Charles T. Groswith, III, Los Altos, Calif.

[73] Assignee: Taurus Tetraconcepts, Inc., Mountain View, Calif.

[21] Appl. No.: 394,340

[22] Filed: Aug. 15, 1989

[51] Int. Cl.[5] ..... B42D 1/00

[52] U.S. Cl. ..... 281/28; 412/43; 412/9; 412/6; 412/38; 402/80 P; 402/60; 281/21.1

[58] Field of Search ..... 281/28, 21.1, 15.1; 402/60, 80 P; 412/38, 43, 6, 7, 20, 24, 9

[56] References Cited

U.S. PATENT DOCUMENTS

| | | | |
|---|---|---|---|
| 3,744,821 | 7/1973 | Abildgaard et al. | 281/21.1 |
| 4,175,340 | 11/1979 | Deutch | 281/28 |
| 4,309,046 | 1/1982 | Giulie | 281/21.1 |
| 4,369,013 | 1/1983 | Abildgaard et al. | 402/60 |
| 4,620,724 | 11/1986 | Abildgaard et al. | 281/15.1 |
| 4,650,426 | 3/1987 | Brigance | 281/15.1 |

*Primary Examiner*—Paul A. Bell
*Assistant Examiner*—Thomas Hamill, Jr.
*Attorney, Agent, or Firm*—Skjerven, Morrill, MacPherson, Franklin & Friel

[57] ABSTRACT

A binding system, employing a first plastic elongated strip with spaced integral studs and a second plastic elongated strip having similarly spaced apertures and recesses, is provided which resists impact forces caused by dropping a bound book. A first fixed spacing of studs is provided along a mid-span portion of the first strip and a second fixed smaller spacing of studs provided at both end portions of the first strip which reinforces the end portions against stud breakage or extrusion caused by impact forces. In the preferred embodiment, the three end studs at each end of the strip are spaced at a second fixed spacing distance stud center-to-center of only one-half the first fixed spacing at the long mid-span portion of the strip. In another embodiment, a generally second fixed spacing of one-third the mid-span spacing with the at least two of the end portion studs being staggered from the center longitudinal axis of the strip is shown. An additional embodiment includes one or more integral studs of the end portions of the strip having a substantially greater cross-sectional area than the studs in the mid-span portion of the strip. In each embodiment, the binding is end reinforced against impact forces.

4 Claims, 1 Drawing Sheet

END-REINFORCED BOOKBINDING STRIP FOR IMPACT RESISTANCE

FIELD OF THE INVENTION

This invention relates to new and improved bookbinding strips for binding a stack of hole-punched paper sheets. More particularly, the invention is directed to a binding system employing pairs of bookbinding strips, one strip having integral studs and the other strip having matching apertures, which resists impact damage.

BACKGROUND OF THE INVENTION

A commonly used bookbinding system is seen in U.S. Pat. No. 4,369,013 issued Jan. 18, 1983 to Messrs. Abildgaard and Groswith (Reissued as Bl 4,369,013 June 14, 1988) and sold as the VeloBind ® system. This system uses elongated plastic strips, one strip having integral studs equally spaced along the strip and fitting through the holes in punched paper and the second strip having round apertures matching the studs, which other strip is placed over the ends of the studs emerging from the paper stack. Upon cinching the strips together to compress a marginal edge of the paper sheets stack, the excess length of the studs are cut off and riveted into recesses formed in the second strip.

In accord with another VeloBind invention seen in U.S. Pat. No. 4,620,724 issued Nov. 4, 1986, the round studs of the '013 design may also be employed for binding a paper sheets stack having punched rectangular holes. In the '724 patent a particular spacing of two studs at one end of the strip is provided so as to prevent lateral displacement of the punch paper in the stack.

While the VeloBind '013 system results in a tight permanent bind which is satisfactory in normal use, it has been found that when a book so bound is dropped or otherwise subjected to an impact, particularly at the end of the strips as shown in FIG. 1, the end riveted studs tend to pop, either by breakage at the root of the stud or extrusion of the plastic rivet head back out of the matching second strip aperture. Impact forces, as seen in FIG. 2, tend to splay out the bound sheets at the strip bottom corner and this action moves the strip ends outwardly as seen in FIG. 3 with the result that the stud is sheared from the strip at its root, and/or due to the resultant tension forces a rear extrusion of the plastic rivet head from the binding, both as seen in FIG. 4. The result of this stud breaking action is the unaesthetic loss of binding symmetry, a loose bottom binding edge, breach of the binding integrity and the resultant unattractive stacking of various bound books or reports.

SUMMARY OF THE INVENTION

In accordance with the present invention the first integral stud-containing strip has a mid-span portion having the integral studs at a first fixed spacing, generally as in the standard VeloBind configuration. However, at each of the ends of the first strip are provided integral studs having a closer spacing and/or having a thicker diameter so as to end-reinforce the binding at both its ends. Thus the combination of an additional binding force comprising multiple studs in the same linear end lengths formerly occupied by only one relatively thin stud, results in each of the strip ends being reinforced and being able to resist appreciably greater impact forces than the prior art binding strips. The improved binding strips of the present invention may include, at the ends thereof, integral studs of greater diameter which improve resistance to shear, tension and compressive forces resultant from impact. In all embodiments, the improved constructions provide an aesthetically pleasing binder of exceptional strength.

Another feature of the invention is that existing VeloBind stud cut-off and riveting machines need be altered only slightly to accommodate the above described strips having closer end spacings and stud thicknesses. Other non-VeloBind machines can also cut-off and upset the stud ends extending from the second strip after assembly of the strips on opposite sides of a properly and correspondingly punched stack of paper sheets.

DETAILED DESCRIPTION

Figure 1:
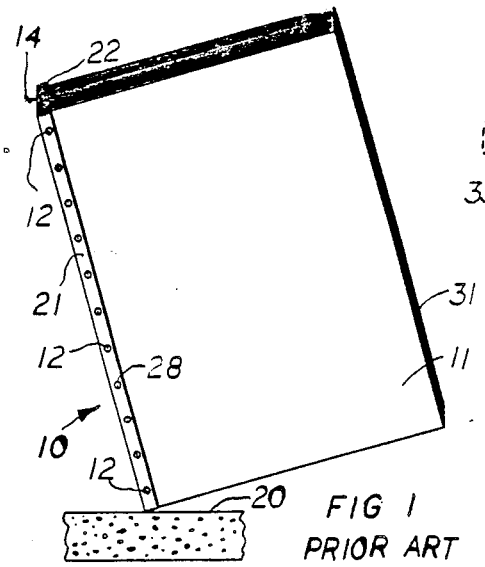
FIG 1 PRIOR ART
FIGS. 1–4 are schematic views of a prior art binding system showing a so-bound book being subjected to impact force (FIG. 1); the resultant expansion and splaying out of the stack of paper sheets (FIG. 2); the physical outward movement of the ends of the strips (FIG. 3); and the resultant fracture by shear and/or tension forces of a stud from the strip and rear extrusion of the rivet head from the rivet head recess (FIG. 4) causing a binding failure.
Figure 2:
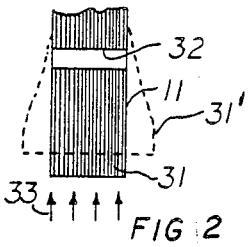
FIG 2 PRIOR ART
Figure 3:
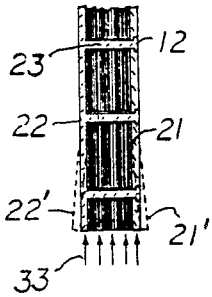
FIG 3 PRIOR ART
Figure 4:
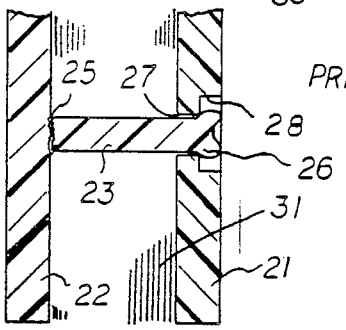
FIG 4 PRIOR ART
Figure 5:
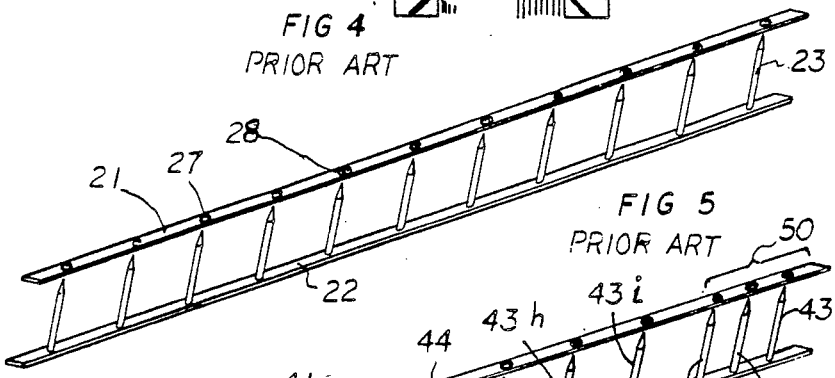
FIG 5 PRIOR ART
FIG. 5 is a perspective view of a VeloBind type binding.

FIG. 1 illustrates a prior art bookbinding 10 positioned on a marginal edge 14 of a stack 11 of punched-hole paper sheets 31. The binding 10 comprises a first strip 22 having a series of integral studs extending therefrom, through the punched holes in the paper stack marginal edge and subsequently upset or riveted to form a head 12 extending in a circular recess 28 in an apertured and recessed second strip 21. The impacting of a so-bound book or report is shown as a result of a drop on a hard floor surface 20. The initial result of such drop when an end of the book hits surface 20 are impact forces indicated by arrows 33 in FIG. 2 causing a splaying out and pushing in of the paper sheets 31 to a nominal dotted position shown at 31'. The sheets tend to separate beyond a position of the endmost aperture 32 through which the integral studs of strip 22 pass. As seen in FIG. 3, the impact forces, if sufficient in magnitude, tend to stress the studs 23 of strip 22 and move the ends of strips 21 and 22 to an outward splayed condition as shown dotted at 21' and 22'. Again, if the forces are sufficient in magnitude, they may exceed the shear and/or tension capabilities of the plastic material, forming the strips. The strips are generally semi-rigid polyvinyl chloride or other, preferably thermoplastic material such as ABS plastic or polystyrene. This action will result as shown in FIG. 4 in fracture and separation of the stud at root 25 and/or a rearward extrusion of the upset head 12 into a dog-bone shaped loosened end 26 which no longer essentially fills the recess 28 in strip 21. FIG. 5 shows the binding of the prior art before assembly on a marginal edge of stack of paper sheets. As seen in FIG. 5, strip 22 has a series of equally-spaced thin integral studs 23 extending orthogonally therefrom typically eleven in number for an 11 inch (28 cm) long strip. Strip 21 is the same length as strip 22 and contains equally spaced circular apertures 27 and circular recesses 28 into which cut-off ends of the studs are upsetted, i.e. riveted after assembly on a paper sheets stack.

Figure 6:
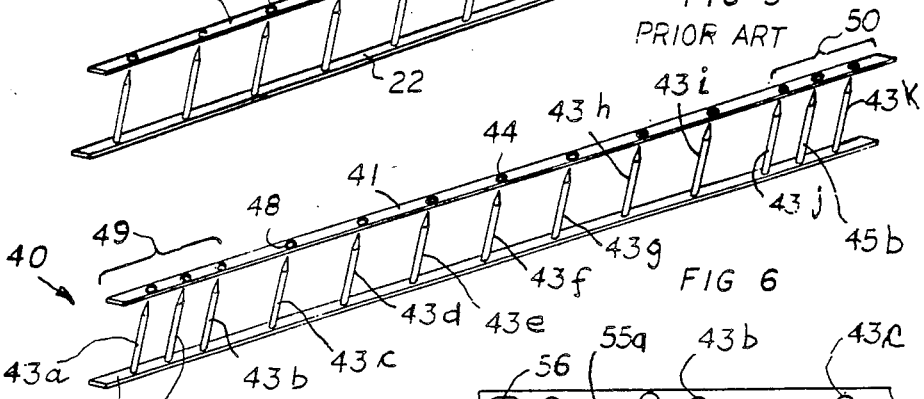
FIG. 6 is a perspective view of the improved end-reinforced binding of this invention.

FIG. 6 shows the binding of the present invention where a first strip 42 has a series of integral studs 43*b*, 43*c*, 43*d*, 43*e*, 43*f*, 43*g*, 43*h*, 43*i*, and 43*j* extending equally spaced over what is termed a "mid-space portion" of the strip. Such spacing in the aforesaid 28 cm strip generally is at a distance of 2.5 cm stud center-to-center, thus forming a stud first fixed spacing in the mid-span portion. Additional integral studs 43*a* and 45*a* are formed at one end of strip 42 and additional studs 43*k* and 45*b* are formed at the opposite end of strip 42 with a second fixed spacing smaller than the first fixed spacing of the other studs with respect to their adjacent studs. This lesser stud second fixed spacing for the 28 cm strip is generally 1.25 cm stud center-to-center. Preferably the second fixed spacing ranges from about 30% to about 70% of its first fixed spacing. Strip 41 is of the same overall length as strip 42 and has correspondingly spaced apertures 44 and recesses 48 over a mid-span portion of the strip and more closely spaced apertures and recesses over each of the end portions 49 and 50 of the strip to receive, respectively, studs 43*a*, 45*q*, 43*b*, and studs 43*j*, 45*b*, 43*k* when assembled on a marginal edge of a paper sheets stack generally in the same manner as shown in FIGS. 1 and 3 of the prior art binding. However, the end portions are reinforced so that impact forces of the same or of a substantial higher degree of magnitude that caused failure of the discussed prior art binding do not cause failure of the improved binding.

Figure 7:
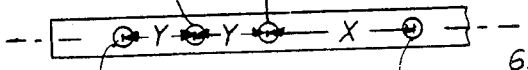
FIG. 7 is a top view of one embodiment of the stud-containing strip as shown in FIG. 6.

FIG. 7 shows a top view of strip 42 clearly showing the relatively wide first fixed spacing X in the mid-span portion of the strip between studs 43*b* and 43*c* and the relatively narrow second fixed spacing Y in the end portions of the strip 43 between studs 43*b* and 45*a* and between studs 45*a* and 43*a*.

Figure 8:
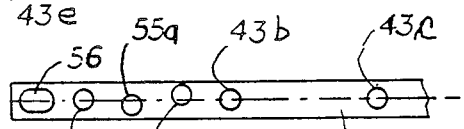
FIG. 8 is a top view of a second embodiment of a stud-containing strip.

FIG. 8 shows a second embodiment of the invention wherein a pair of integral studs 55*a* and 55*b* are provided at a still smaller second fixed spacing Z between studs 43*a* and 43*b*. Studs 55*a* and 55*b* may have centers which are staggered from the central longitudinal axis 60 of the strip which contains the centers of studs 43*a*, 43*b*, and 43*c*. Further, an additional oval stud 56 may be provided to further increase impact resistance.

Figure 9:
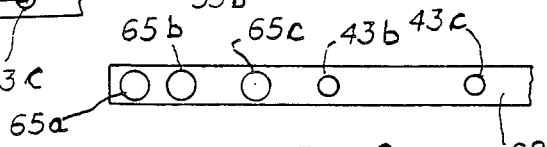
FIG. 9 is a top view of a third embodiment of a stud-containing strip.

FIG. 9 shows a third embodiment wherein a strip 62 is end-reinforced at each end by one or more integral studs 65*a*, 65*b*, and 65*c* having a larger cross-sectional area, for example, 0.43 mm in diameter, and hence more impact resistance, than the relatively thin and relatively small cross-area (0.25 mm in diameter) studs in the mid-span portion of the strip, represented by studs 43*b* and 43*c*. The studs 65*a*, 65*b*, and 65*c* may be at variously smaller stud center-to-center spacings than the first fixed spacing between studs 43*b* and 43*c*, in the mid-span portion. Further, the studs may have various cross-sectional shapes, such as square or rectangular, other than the illustrated round and oval studs.

The above description of embodiments of this invention is intend to be illustrative and not limiting. Other embodiments of this invention will be obvious to those skilled in the art in view of the above disclosure.

I claim:

1. In a binding system for use in binding a stack of paper sheets formed with a plurality of margin apertures, a first elongated strip having a plurality of integral spaced-apart studs projecting orthogonally therefrom and a second elongated strip formed with spaced-apart strip apertures corresponding to the spacing of said integral studs on said first strip, said integral studs being dimensioned and positioned to fit into said strip apertures in said second strip with a stack of paper sheets between said strips, the improvement comprising wherein said first strip has a mid-span portion having said integral studs at a first fixed spacing and said integral studs in said mid-span portion having a first cross-sectional area and wherein each end portion of said first strip has other of said integral studs at a second fixed spacing smaller than said first fixed spacing and said integral studs in said end portions having a second cross-sectional area greater than the first cross-sectional area of said integral studs in said first strip mid-span portion.

2. The binding system of claim 1 in which an end one of said integral studs closest to each end of the first strip is of greater cross-sectional area than those other integral studs extending over the mid-span portion of said first strip.

3. The binding system of claim 1 including a pair of integral studs at each end of said strips wherein said pairs of integral studs are each of greater cross-sectional area and are at a second closer spacing than those integral studs extending over the mid-span portion of said first strip.

4. In a binding system for use in binding a stack of paper sheets formed with a plurality of margin apertures, a first elongated strip having a plurality of integral spaced-apart studs projecting orthogonally therefrom and a second elongated strip formed with spaced-apart strip apertures corresponding to the spacing of said integral studs on said first strip, said integral studs being dimensioned and positioned to fit into said strip apertures in said second strip with a stack of paper sheets between said strips, the improvement comprising wherein said first strip comprises a central portion having said integral studs dimensioned with a first cross-sectional area and a pair of first strip end portions extending from said central portion having said integral studs thereon dimensioned with a second cross-sectional area greater than the first cross-sectional area of said integral studs in said first strip central portion such that said binding strips upon assembly with said stack of paper sheets are end-strengthened for impact resistance.

* * * * *